US008198877B2

(12) United States Patent
Kuan et al.

(10) Patent No.: US 8,198,877 B2
(45) Date of Patent: Jun. 12, 2012

(54) LOW VOLTAGE DROP OUT REGULATOR

(75) Inventors: Chien-wei Kuan, Hsinchu (TW); Yen-hsun Hsu, Hengshan Township (TW)

(73) Assignee: Mediatek Inc., Hsin-Chu (TW)

( * ) Notice: Subject to any disclaimer, the term of this patent is extended or adjusted under 35 U.S.C. 154(b) by 429 days.

(21) Appl. No.: 12/491,805

(22) Filed: Jun. 25, 2009

(65) Prior Publication Data

US 2010/0327830 A1 Dec. 30, 2010

(51) Int. Cl.
*G05F 1/40* (2006.01)

(52) U.S. Cl. ..... 323/280; 323/273

(58) Field of Classification Search ..... 323/273–275, 323/280

See application file for complete search history.

(56) References Cited

U.S. PATENT DOCUMENTS

| | | | | |
|---|---|---|---|---|
| 4,908,566 | A * | 3/1990 | Tesch | 323/280 |
| 6,300,749 | B1 * | 10/2001 | Castelli et al. | 323/273 |
| 6,703,816 | B2 * | 3/2004 | Biagi et al. | 323/280 |
| 7,218,082 | B2 * | 5/2007 | Walter et al. | 323/273 |
| 7,612,548 | B2 * | 11/2009 | Jian | 323/280 |

* cited by examiner

*Primary Examiner* — Matthew Nguyen

(74) *Attorney, Agent, or Firm* — Kirton McConkie; Evan R. Witt

(57) ABSTRACT

A low voltage drop out (LDO) regulator is disclosed. The LDO regulator has a voltage buffer for receiving an input voltage containing a DC component and an AC component, converting the input voltage into a converted voltage having a lower DC component and an AC component following that of the input voltage; a control stage applied with the converted voltage; and an output stage applied with the input voltage. The output stage is controlled by the control stage to output an output voltage of a specific level. In the LDO regulator, elements of small sizes can be used to save a layout area thereof. In the meanwhile, the LDO regulator can maintain a high power supply rejection ratio (PSRR) characteristic.

13 Claims, 4 Drawing Sheets

LOW VOLTAGE DROP OUT REGULATOR

TECHNICAL FIELD OF THE INVENTION

The present invention relates to voltage regulators, more particularly, to a low voltage drop out (LDO) regulator having a high power supply rejection ratio (PSRR).

BACKGROUND OF THE INVENTION

Voltage regulators are used to provide a stable voltage source to other electronic circuits. Low voltage drop out (LDO) regulators are widely used in modern applications since the operation voltages of the modern electronic devices are going lower and lower than an external supply voltage. FIG. 1 schematically and generally illustrates an LDO regulator 100 of prior art. A battery voltage (i.e. external supply voltage) $V_{BAT}$, which is 4.3V, for example, is supplied to the LDO regulator 100 as an input voltage. The LDO regulator 100 comprises multiple sub-LDO regulators 110, 120, . . . , 190. Each sub-LDO regulator is used to provide a specific output voltage (e.g. $V_{OUT1}$, $V_{OUT2}$ . . . or $V_{OUTN}$). Taking the sub-LDO regulator 110 as an example, the sub-LDO regulator 110 has a control stage 112, an output stage 114 and a compensation block 113 connected between the control stage 112 and the output stage 114. The external supply voltage $V_{BAT}$ is supplied to the control stage 112 and the output stage 114. This is similar to the other sub-LDO regulators. Since the entire LDO regulator 100 sustains the high voltage, elements (e.g. transistors) of great sizes must be used. Alternatively, a cascade structure must be utilized. To save a layout area for the LDO regulator, a pre-regulator is added as shown in FIG. 2.

FIG. 2 schematically and generally illustrates another LDO regulator 200 of prior art. The like reference numbers in FIG. 1 and FIG. 2 indicate the same components. The difference between the LDO regulators 100, 200 of FIG. 1 and FIG. 2 is that the LDO regulator 200 further has a high voltage (HV) regulator 205. The HV regulator 205 converts the high input voltage $V_{BAT}$ (e.g. 4.3V) to a lower voltage such as 2.8V or 3.3V. The lower voltage from the HV regulator 205 is then provided to a control stage 212 of a sub-LDO regulator 210. The battery voltage $V_{BAT}$ is still fed to an output stage 214. This is similar to the other sub-LDO regulators 220 to 290.

The battery voltage (i.e. the external supply voltage) $V_{BAT}$ usually includes an AC perturbation having a peak-to-peak value of about 200 mV in addition to a DC component of 4.3V in this example. After the battery voltage $V_{BAT}$ passes through the HV regulator 205 and is converted into a converted voltage $V_{CON}$, the DC component is converted from 4.3V to 2.8 or 3.3V, for example. Furthermore, the AC perturbation is filtered out. The electrical signal at a node A (i.e. $V_{BAT}$) in FIG. 2 includes the DC component and the AC perturbation, while the electrical signal at a node B (i.e. $V_{CON}$) only has the converted DC voltage. Therefore, the effect of the AC perturbation cannot be suppressed, resulting in degradation of a Power Supply Rejection Ratio (PSRR) characteristic of the LDO regulator 200. In addition, the use of the HV regulator 205 requires an additional power consumption and an additional occupation of the layout area.

SUMMARY OF THE INVENTION

The present invention is to provide a low voltage drop out (LDO) regulator, in which elements of small sizes can be used so as to save a layout area thereof. In the meanwhile, the LDO regulator of the present invention maintains a high power supply rejection ratio (PSRR) characteristic.

The present invention also provides a method for improving a power supply rejection ratio (PSRR) of a low voltage drop out (LDO) regulator having a control stage and an output stage which is connected with the control stage and controlled by the same.

In accordance with the present invention, a low voltage drop out (LDO) regulator comprises a voltage buffer for receiving an input voltage containing a DC component of a first level and an AC component, converting the input voltage into a converted voltage, the converted voltage having a DC component of a second level lower than the first level and an AC component following that of the input voltage; a control stage having a first amplifier applied with the converted voltage from the voltage buffer; and an output stage having a power transistor connected with an output of the first amplifier of the control stage, the power transistor being applied with the input voltage and being controlled by the control stage to output an output voltage of a third level.

The LDO regulator of the present invention further has a compensation block for causing a pole splitting is provided between the control stage and the output stage.

The control stage of the LDO regulator of the present invention may have two or more amplifiers cascaded together. Each amplifier in the control stage is applied with the converted voltage having the lower DC component as compared to the input voltage and the AC component following that of the input voltage.

In accordance with the present invention, a method for improving the power supply rejection ratio (PSRR) of the low voltage drop out (LDO) regulator comprises converting an input voltage containing a DC component of a first level and an AC component into a converted voltage having a DC component of a second level and an AC component following the AC component of the input voltage; applying the converted voltage to the control stage and applying the input voltage to the output stage; and applying a reference voltage to the control stage so that the control stage controls the output stage to output an output voltage of a third level.

BRIEF DESCRIPTION OF THE DRAWINGS

The present invention will be further described in detail in conjunction with the accompanying drawings.

DETAILED DESCRIPTION OF THE INVENTION

Figure 3:
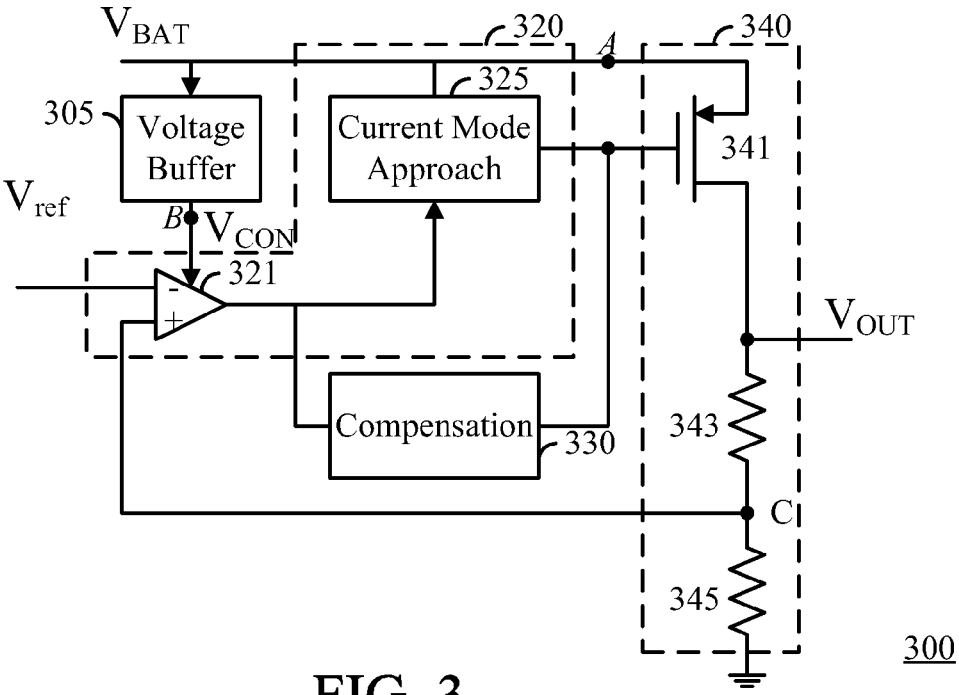
FIG. 3 schematically and generally illustrates an LDO regulator of an embodiment in accordance with the present invention.

FIG. 3 schematically and generally illustrates an LDO regulator 300 of an embodiment in accordance with the present invention. The LDO regulator 300 comprises a voltage buffer 305, a control stage 320, a compensation block 330 and an output stage 340. In accordance with the present invention, the voltage buffer 305 converts a DC component of a high input voltage (i.e. a battery voltage of 4.3V, for example) $V_{BAT}$ into a converted voltage $V_{CON}$ of a lower level (e.g. 3.3V or 2.8V). In the meanwhile, an AC component (i.e. AC perturbation) with a peak-to-peak value of about 200 mV passes through the voltage buffer 305 without being filtered out. That is, the output $V_{CON}$ of the voltage buffer 305 (i.e. a signal at a node B) contains the lower DC voltage and the AC component following the AC component of $V_{BAT}$. By using the voltage buffer 305, the voltages applied to the control stage 320 and output stage 340 both contain the AC components. The details will be further described later.

The control stage 320 includes an amplifier 321 and a current mode approach block 325. A reference voltage $V_{ref}$ is fed to an inverting input of the amplifier 321. A non-inverting input of the amplifier 321 is connected with a voltage divider consisting of resistors 343 and 345 in the output stage 340. The voltage developed at a node C is fed back to the non-inverting input of the amplifier 321. An output of the amplifier 321 is connected to the current mode approach block 325. The current mode approach block 325 is used to transfer the output of the amplifier 321 from a lower voltage level to a higher voltage level so as to prevent the LDO regulator 300 from a voltage stress. The output stage 340 comprises a power transistor 341, which is implemented by a power PMOS transistor in the present embodiment, and the voltage divider consisting of the resistors 343 and 345. The power transistor 341 is a path element. The battery voltage $V_{BAT}$ is connected to a source of the power transistor 341. An output of the current mode approach block 325 is connected to a gate of the power transistor 341. A drain of the power transistor 341 is connected to the voltage divider as an output of the LDO regulator 300 for outputting a regulated voltage $V_{OUT}$. According to a difference between the reference voltage $V_{ref}$ and the feedback voltage from node C, the amplifier 321 controls the gate voltage of the power transistor 341 so that the power transistor 341 outputs the regulated output voltage of a specific level, which is substantially determined by the reference voltage $V_{ref}$.

The control stage 320 is fed with the lower voltage $V_{CON}$ converted by the voltage buffer 305. That is, the control stage 320 is in a low power domain. Therefore, components of smaller sizes can be used in the control stage 320. In contrast, the output stage 340 is directly fed with the battery voltage $V_{BAT}$, and therefore the output stage 340 is in a high power domain. The compensation block 330 is connected between these two different power domains. The compensation block 330 is connected between the output of the amplifier 321 and the gate of the power transistor 341. The compensation block 330 is used to implement a Miller compensation, that is, to cause a phenomenon of "pole splitting", which is well known in this field. The compensation block 300 generates a dominant pole at the low power domain side, and pushes a pole at the high power domain away, and thereby improving the stability of the LDO regulator 300.

As can be seen, the signal at a node A of this drawing is the battery voltage $V_{BAT}$, which contains the DC component and the AC component (i.e. AC perturbation). In addition, as described above, by converting the input battery voltage $V_{BAT}$ into the converted voltage $V_{CON}$ without filtering out the AC component, the signal at the node B (i.e. $V_{CON}$) contains the DC component lower than that of $V_{BAT}$ and the AC component following that of $V_{BAT}$. Accordingly, the AC perturbations appear at both the source and gate of the power transistor 341. As can be seen, a gate-to-source voltage $V_{GS}$ of the power transistor 341 will be constant since the effect of the AC perturbation is cancelled out. Therefore, the power supply rejection ratio (PSRR) of the regulator 300 is improved.

Figure 4:
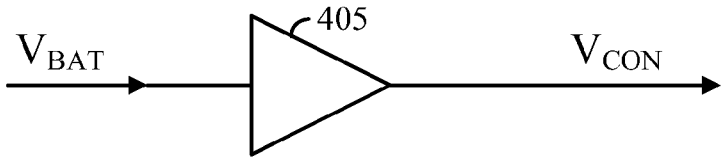
FIG. 4 shows an implementation example of a voltage buffer of the LDO regulator of FIG. 3.

The voltage buffer 305 can be implemented by any appropriate electronic element or circuit to achieve the functions of converting down the DC component while substantially maintaining the AC component of the input signal. FIG. 4 shows an implementation example of the voltage buffer 305. The voltage buffer 305 can be simply implemented by an amplifier 405. When the battery voltage $V_{BAT}$ containing the DC component and AC component is inputted to the amplifier 405, the amplifier 405 outputs a voltage signal $V_{CON}$, of which a DC component is regulated to a lower level as compared to $V_{BAT}$ and an AC component thereof follows the AC component of $V_{BAT}$.

Figure 5:
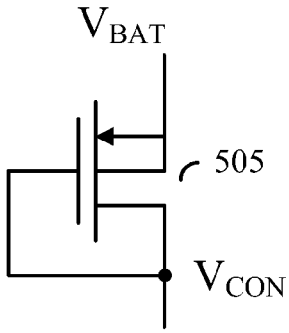
FIG. 5 shows another implementation example of the voltage buffer of the LDO regulator of FIG. 3.

FIG. 5 shows another implementation example of the voltage buffer 305. The voltage buffer 305 can be simply implemented by a PMOS transistor 505. A source and a bulk of the transistor 505 are fed with the battery voltage $V_{BAT}$ containing the DC component and the AC component, while a gate and a drain thereof are connected together. An output $V_{CON}$ at the drain of the transistor 505 contains a DC component regulated to a lower level as compared to $V_{BAT}$ and an AC component following the AC component of $V_{BAT}$.

Figure 1:
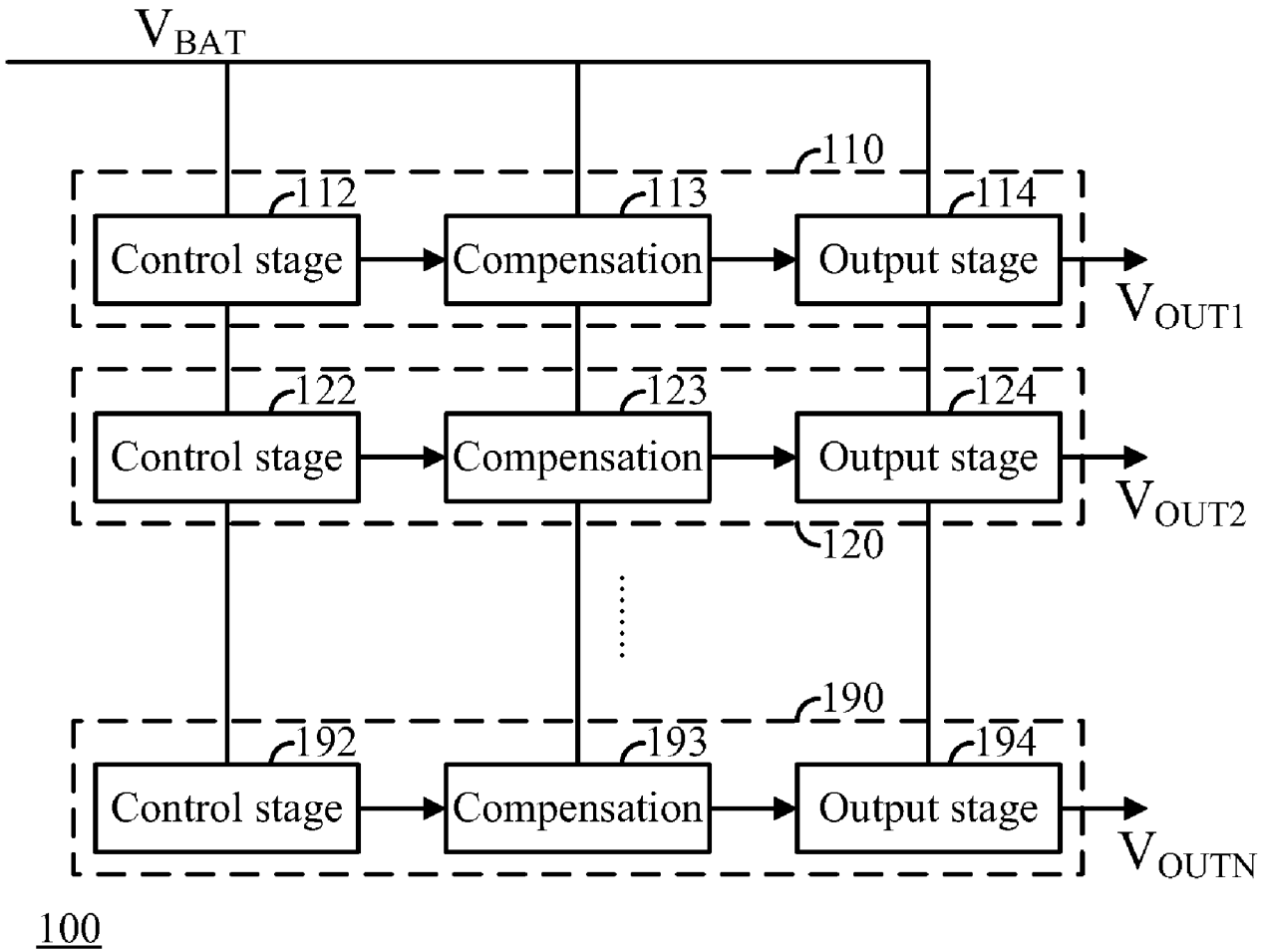
FIG. 1 Prior Art
FIG. 1 schematically and generally illustrates an LDO regulator of prior art.
Figure 2:
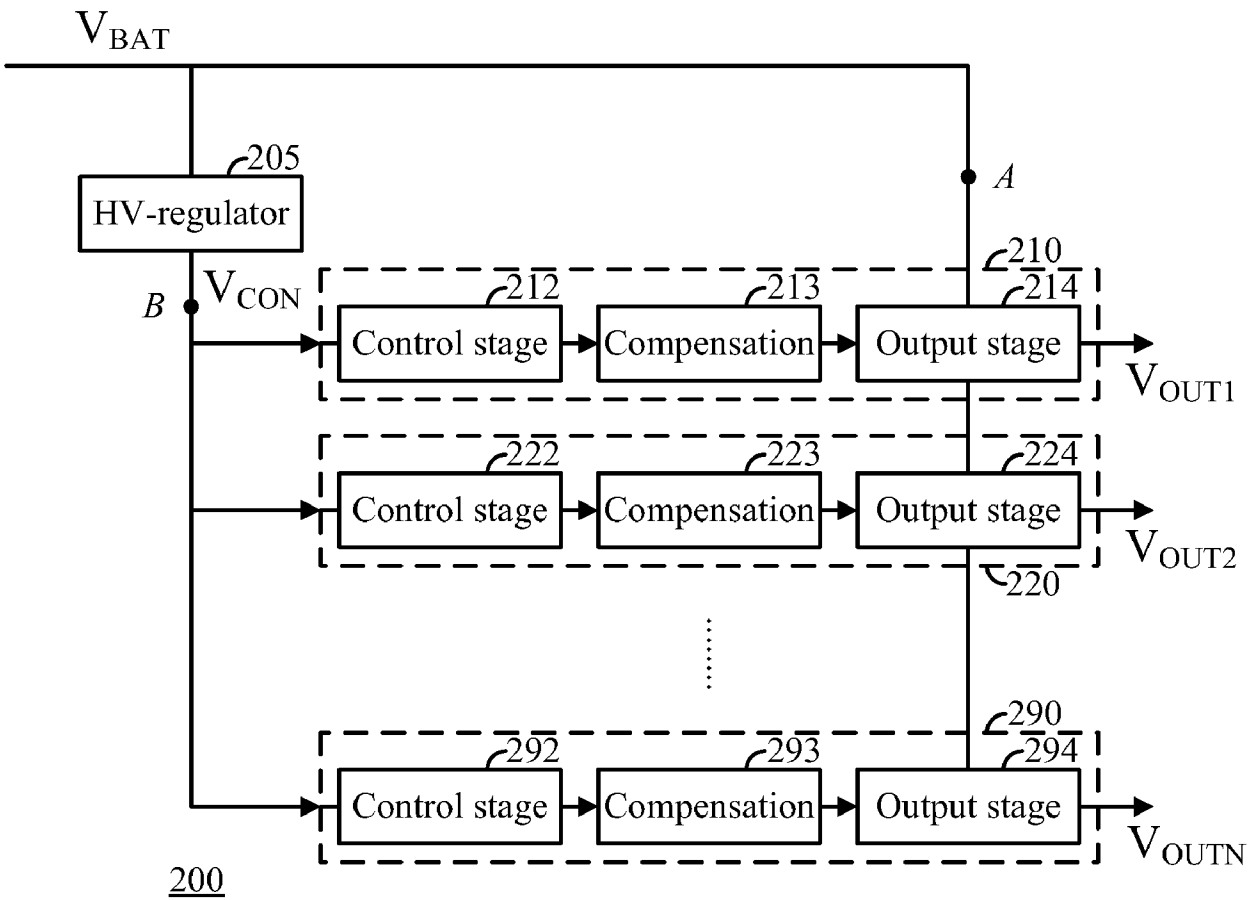
FIG. 2 Prior Art
FIG. 2 schematically and generally illustrates another LDO regulator of prior art.
Figure 6:
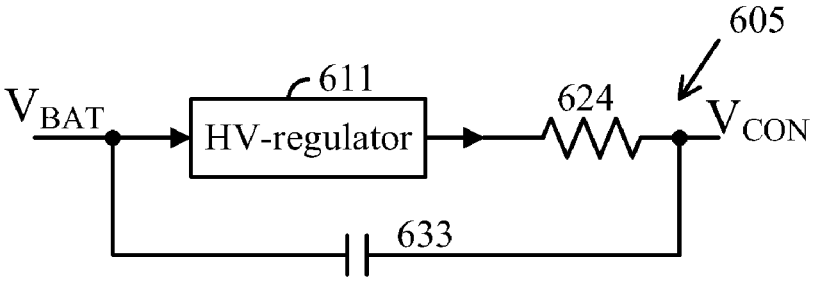
FIG. 6 shows a further implementation example of the voltage buffer of the LDO regulator of FIG. 3.

Alternatively, the voltage buffer 305 can be implemented by a circuit 605 shown in FIG. 6. FIG. 6 shows a further implementation example of the voltage buffer 305. The circuit 605 comprises an HV regulator 611, a resistor 624 connected with the HV regulator 611 in series, and a capacitor 633 connected with the connection of the HV regulator 611 and the resistor 624 in parallel. The HV regulator 611 is the same as the HV regulator 205 of FIG. 2. The HV regulator 611 and the resistor 624 reduce a DC component of a battery voltage $V_{BAT}$. In this path, an AC component is filtered out. In the other path having the capacitor 633, the DC component of $V_{BAT}$ is blocked and the AC component passes through. Therefore, an output $V_{CON}$ of this circuit 605, which is a combination of the outputs of the two paths, has a reduced DC component as compared to $V_{BAT}$ and an AC component following the AC component of $V_{BAT}$.

Figure 7:
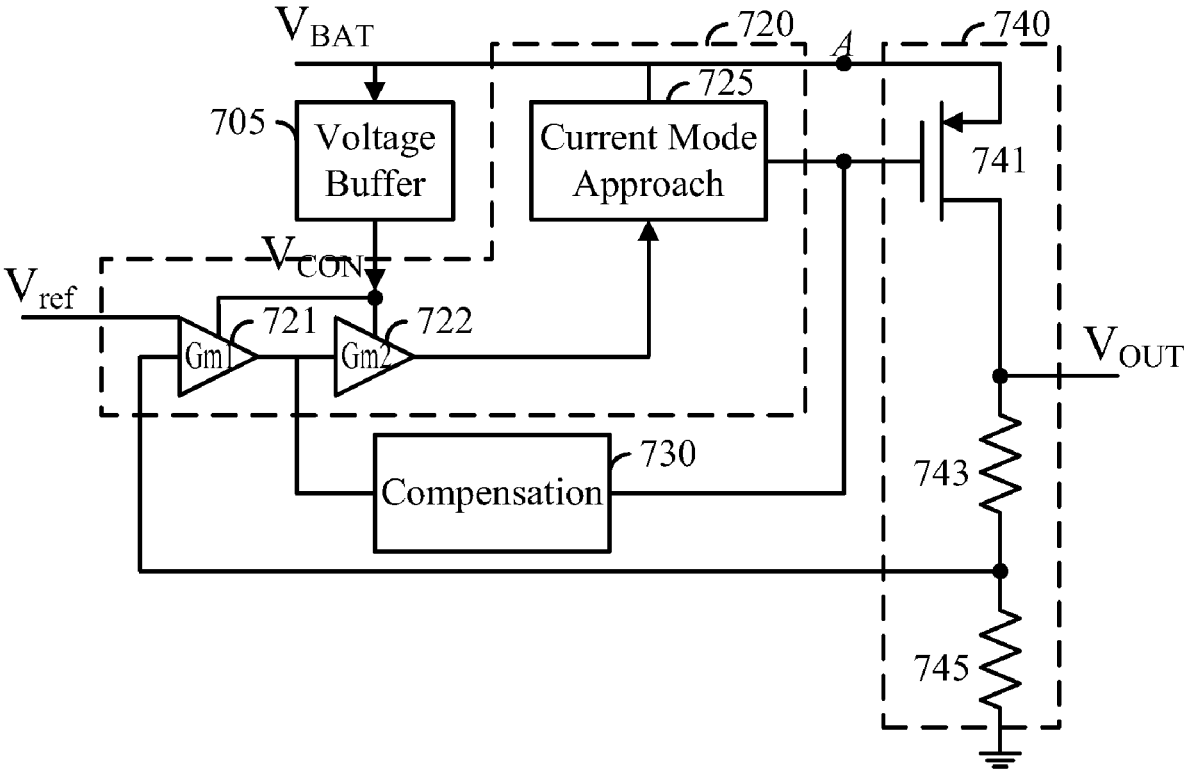
FIG. 7 schematically and generally illustrates an LDO regulator of another embodiment in accordance with the present invention.

FIG. 7 schematically and generally illustrates an LDO regulator 700 of another embodiment in accordance with the present invention. The LDO regulator 700 in the present embodiment is similar to the LDO regulator 300 in FIG. 3. Like reference numbers indicate the same components. The essential difference is that two amplifiers 721 and 722 are cascaded in a control stage 720 of the LDO regulator 700 in accordance with the present embodiment. That is, the LDO regulator 700 has two amplification stages. A high battery voltage $V_{BAT}$ (e.g. 4.3V) is inputted to the LDO regulator 700. The input voltage $V_{BAT}$ is converted down as a converted voltage $V_{CON}$ (e.g. 3.3V or 2.8V) by a voltage buffer 705, which is the same as the voltage buffer 305 of the previous embodiment. An AC component of the battery voltage $V_{BAT}$ is not filtered out, so that the converted voltage $V_{CON}$ also has an AC component following the AC component of $V_{BAT}$. The converted voltage $V_{CON}$ is fed to the two amplifiers 721 and 722. The first amplifier 721 has one input thereof receive a reference voltage $V_{ref}$, and the other input thereof be connected to a voltage divider consisting of resistors 743 and 745. An output of the first amplifier 721 is connected to the second amplifier 722 and a compensation block 730, which is the same as the compensation block 330 of the previous embodiment. An output of the second amplifier 722 is connected to a current mode approach block 725, which is the same as the current mode approach block 325 of the previous embodiment. As can be seen, the voltages applied to the amplification stages and the output stage all contains AC components.

Based on a practical requirement, the control stage of the LDO regulator in accordance with the present invention may include more than two amplifiers cascaded together. That is, there can be more than two amplification stages. No matter how many amplification stages are in the control stage, these amplification stages are all fed with the converted voltage with the AC component following the AC component of the input battery voltage $V_{BAT}$. By doing so, AC components will be seen at the source and gate of the power transistor of the output stage, so that the gate-to-source voltage $V_{GS}$ of the power transistor can be substantially maintained constant. Accordingly, the PSRR of the LDO regulator of the present invention is high.

While the preferred embodiment of the present invention has been illustrated and described in detail, various modifications and alterations can be made by persons skilled in this art. The embodiment of the present invention is therefore described in an illustrative but not in a restrictive sense. It is intended that the present invention should not be limited to the particular forms as illustrated, and that all modifications and alterations which maintain the spirit and realm of the present invention are within the scope as defined in the appended claims.

What is claimed is:

1. A low voltage drop out (LDO) regulator comprising:

a voltage buffer for receiving an input voltage containing a DC component of a first level and an AC component, converting the input voltage into a converted voltage, the converted voltage having a DC component of a second level lower than the first level and an AC component following that of the input voltage;

a control stage having a first amplifier applied with the converted voltage; and an output stage having a power transistor connected with an output of the first amplifier of the control stage, the power transistor being applied with the input voltage and being controlled by the control stage to output an output voltage of a third level.

2. The LDO regulator of claim 1, further comprising a compensation block connected between the control stage and the output stage for causing a pole splitting.

3. The LDO regulator of claim 1, wherein the control stage further has a current mode approach block connected between the first amplifier and the power transistor for transferring the output of the first amplifier from a lower level to a higher level.

4. The LDO regulator of claim 1, wherein the control stage further has a second amplifier, which is cascaded with the first amplifier and is connected between the first amplifier and the power transistor, the second amplifier is also applied with the converted voltage.

5. The LDO regulator of claim 4, wherein the control stage further has a current mode approach block connected between the second amplifier and the power transistor for transferring an output of the second amplifier from a lower level to a higher level.

6. The LDO regulator of claim 1, wherein the voltage buffer comprises an amplifier for receiving the input voltage, converting the input voltage into the converted voltage and outputting the converted voltage.

7. The LDO regulator of claim 1, wherein the voltage buffer comprises a transistor having a source and a bulk thereof applied with the input voltage, and having a gate and a drain thereof connected together as an output for outputting the converted voltage.

8. The LDO regulator of claim 1, wherein the voltage buffer comprises:

a high voltage regulator receiving the input voltage for converting the DC component of the input voltage to a lower level and filtering out the AC component;

a resistor connected with the high voltage regulator in series to form a connection; and a capacitor connected with the connection of the high voltage regulator and the resistor in parallel for blocking the DC component of the input voltage while allowing the AC component to pass through.

9. The LDO regulator of claim 1, wherein the output stage further comprises a voltage divider consisting of plural resistors, the voltage divider is connected with the power transistor.

10. The LDO regulator of claim 1, wherein the power transistor has a source receiving the input voltage, a gate connected with the control stage and a drain outputting the output voltage.

11. The LDO regulator of claim 10, wherein the power transistor is a PMOS transistor.

12. A method for improving a power supply rejection ratio (PSRR) of a low voltage drop out (LDO) regulator, the LDO regulator comprising a control stage having a first amplifier and an output stage having a power transistor connected to an output of the first amplifier of the control stage, the method comprising steps of:

converting an input voltage containing a DC component of a first level and an AC component into a converted voltage having a DC component of a second level and an AC component following the AC component of the input voltage;

applying the converted voltage to the control stage and applying the input voltage to the output stage; and applying a reference voltage to the control stage so that the control stage controls the output stage to output an output voltage of a third level.

13. The method of claim 12, further comprising a step of providing a compensation block for causing a pole splitting between the control stage and the output stage.

* * * * *